United States Patent [19]

Iida

[11] Patent Number: 4,550,754

[45] Date of Patent: Nov. 5, 1985

[54] WEFT PICKING SYSTEM OF LOOM AND METHOD FOR OPERATING SAME

[75] Inventor: Hideo Iida, Hachioji, Japan

[73] Assignee: Nissan Motor Co., Ltd., Yokohama, Japan

[21] Appl. No.: 619,197

[22] Filed: Jun. 11, 1984

[30] Foreign Application Priority Data

Jun. 29, 1983 [JP] Japan ..... 58-116168
Jun. 29, 1983 [JP] Japan ..... 58-116171

[51] Int. Cl.[4] ..... D03D 47/36
[52] U.S. Cl. ..... 139/452; 242/47.01
[58] Field of Search ..... 139/452; 242/47.01; 364/470

[56] References Cited

U.S. PATENT DOCUMENTS 3,737,112 6/1973 Tellerman ..... 242/47.01
4,092,006 5/1978 Jacobsson ..... 242/47.01
4,226,379 10/1980 Brouwer ..... 242/47.01
4,298,172 11/1981 Hellstrom ..... 242/47.01
4,368,854 1/1983 Valois ..... 242/47.01
4,397,340 8/1983 Umezawa ..... 139/452
4,452,402 6/1984 Ghiardo ..... 242/47.01

FOREIGN PATENT DOCUMENTS 58-31145 2/1983 Japan .

*Primary Examiner*—Henry S. Jaudon
*Assistant Examiner*—Steven Shongut
*Attorney, Agent, or Firm*—Schwartz, Jeffery, Schwaab, Mack, Blumenthal & Evans

[57] ABSTRACT

A weft picking system of a loom comprises a weft winding-guide arm which wounds a weft yarn around a stationary drum in order to measure a weft length to be required for one pick of the weft yarn. The weft winding-guide arm is driven by a pulse motor whose revolution speed is slowly decreased from a predetermined level toward a stoppage of revolution of the pulse motor so as to measure a predetermined part of a required weft length, while is slowly increased into the predetermined level since the initiation of the pulse motor revolution so as to measure a remainder part of the required weft length, thereby effectively preventing the weft yarn from being cut.

22 Claims, 10 Drawing Figures

WEFT PICKING SYSTEM OF LOOM AND METHOD FOR OPERATING SAME

BACKGROUND OF THE INVENTION

1. Field of the Invention

This invention relates to a weft picking system of a loom, and more particularly to the system of the type wherein a plurality of weft yarns of different types are selectively picked particularly for the purpose of multiple color weaving and a method of operating the same system.

2. Description of the Prior Art

In connection with a weft picking system of the type wherein a predetermined weft yarn is selected from a plurality of weft yarns of different types, particularly colors, to be picked, measuring out a weft length to be required for one pick of the weft yarn has been hitherto achieved, for example, by winding up the weft yarn around a stationary drum by means of a weft winding-guide arm which rotates several times and stops. In this case, the weft winding-guide arm is so operated that the rotational speed thereof abruptly rises for rotation and abruptly falls to stop. As a result, the weft yarn is subjected to an abrupt change in tension and weft yarn cutting occurs, particularly in the case where a cotton yarn is used as the weft yarn.

SUMMARY OF THE INVENTION

In a weft picking system and a method of operating the same in accordance with the present invention, a weft winding-guide arm is driven to rotate around a stationarily maintained drum by means of a pulse motor. The revolution speed of the pulse motor is slowly decreased from a predetermined high level until the pulse motor stops (hereinafter referred to as "slow-down mode operation") to measure out a predetermined part of a weft length to be required for one pick of the weft yarn by a point in time at which the pulse motor stops. The pulse motor speed is slowly increased to the predetermined level (hereinafter referred to as "slow-up mode operation") to measure a remainder of the weft length by a point in time at which weft picking terminates. Accordingly, the weft yarn to be picked is not subjected to an abrupt change in tension and therefore is effectively prevented from being cut.

BRIEF DESCRIPTION OF THE DRAWINGS

The features and advantages of the weft picking system and the method for operating the same in accordance with the present invention will be more apparent from the following description taken in conjunction with the accompanying drawings in which the same reference numerals and characters designate the same parts and elements, and in which.

DETAILED DESCRIPTION OF THE INVENTION

Figure 1:
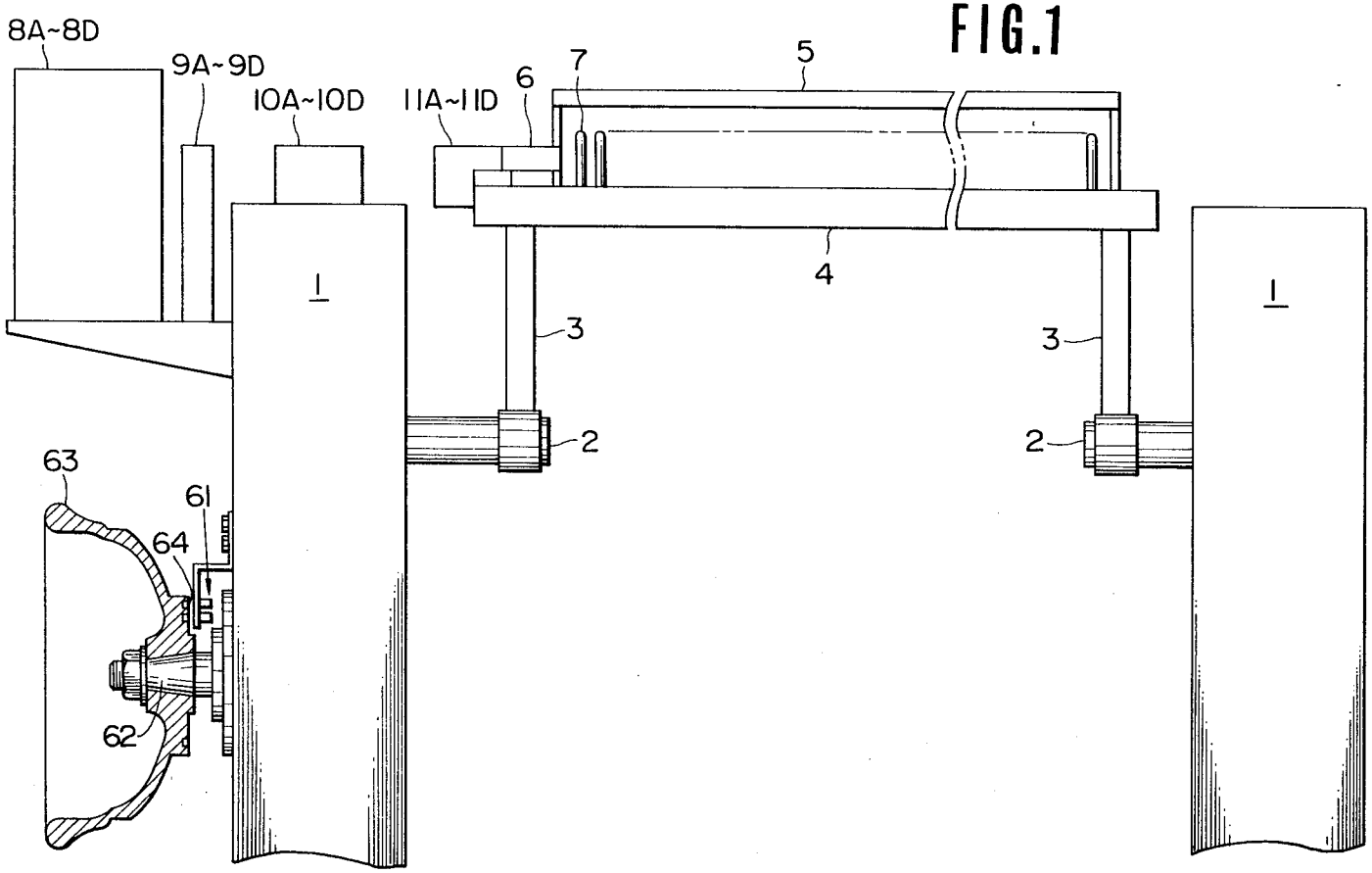
FIG. 1 is a schematic front view of an essential part a loom to which the principle of the present invention is applied.
Figure 2:
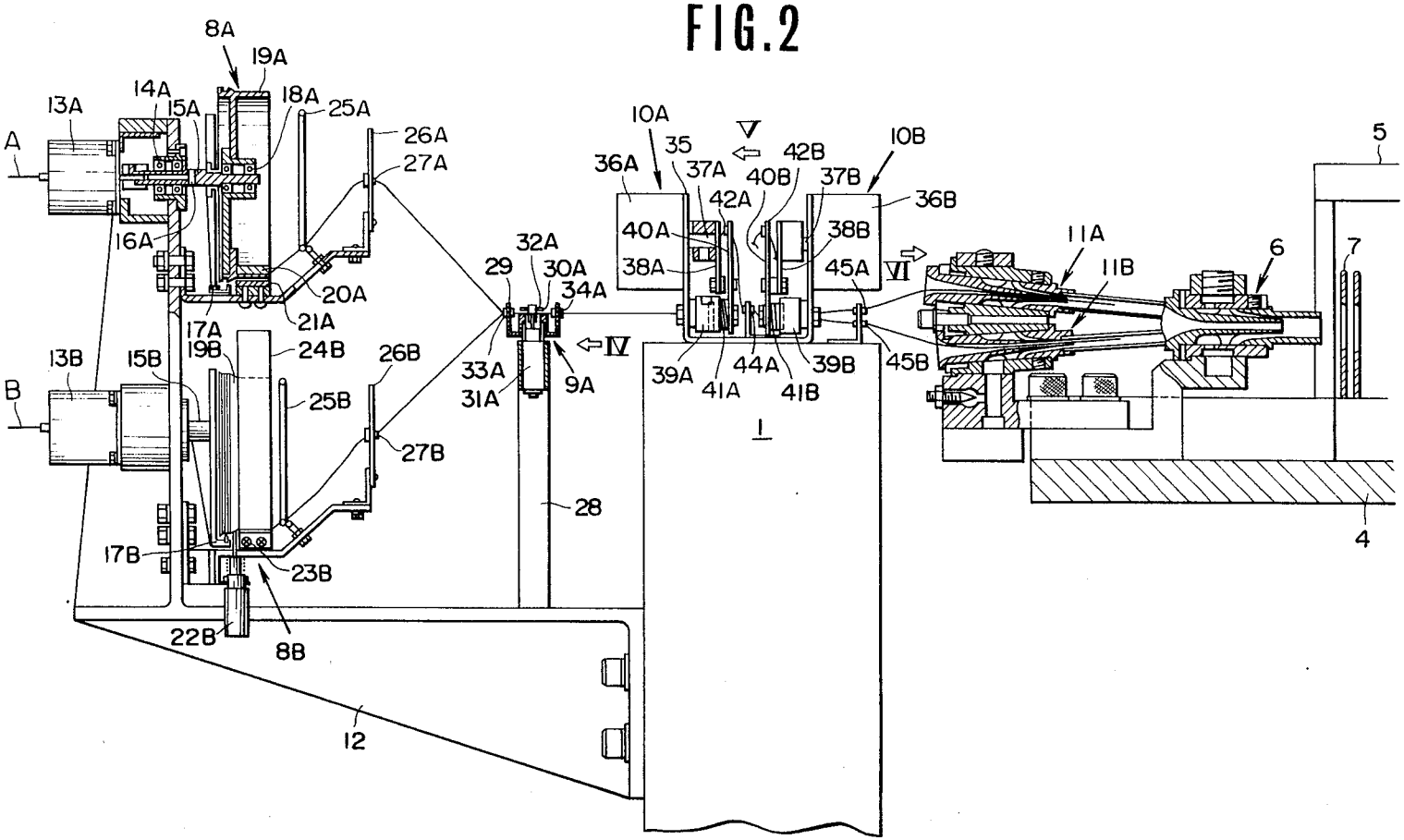
FIG. 2 is a front view, partly in section, of a weft picking system of the loom of FIG. 1, in accordance with the present invention.
Figure 3:
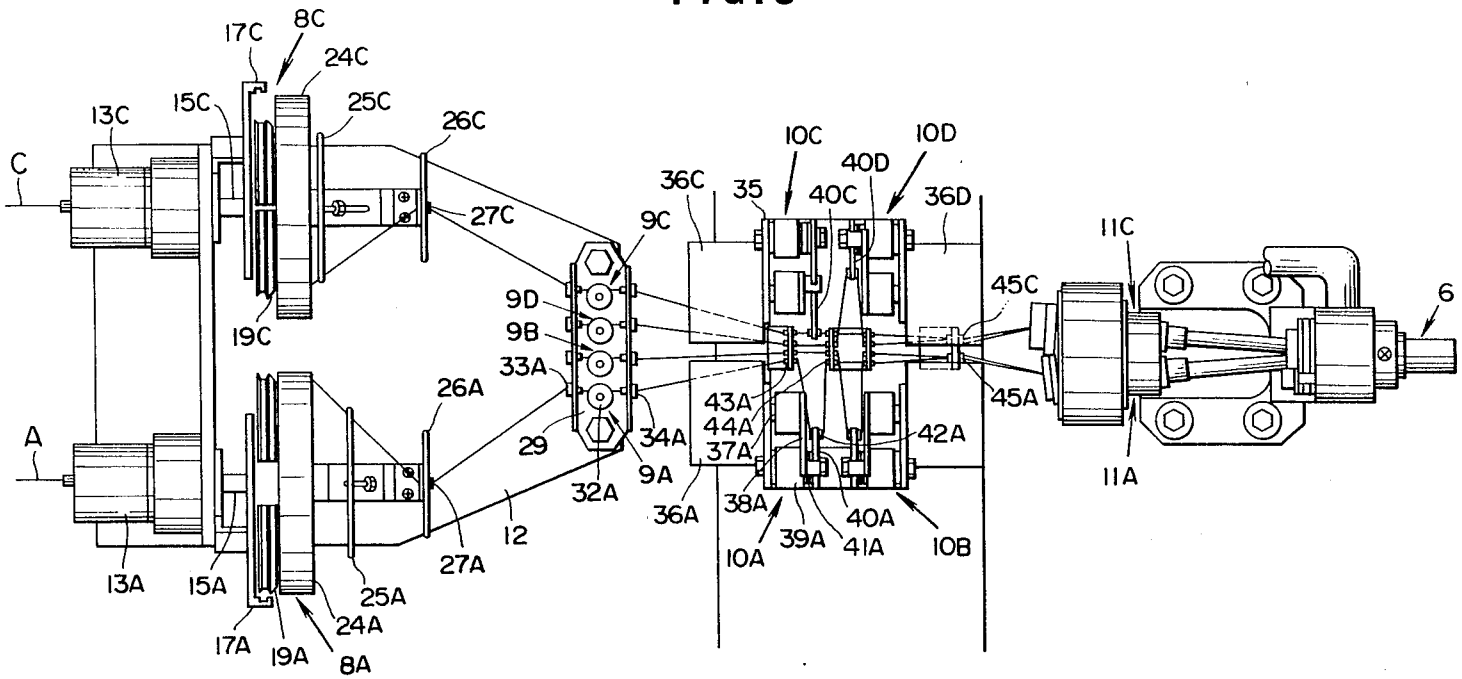
FIG. 3 is a plan view of the weft picking system of FIG. 2.
Figure 4:
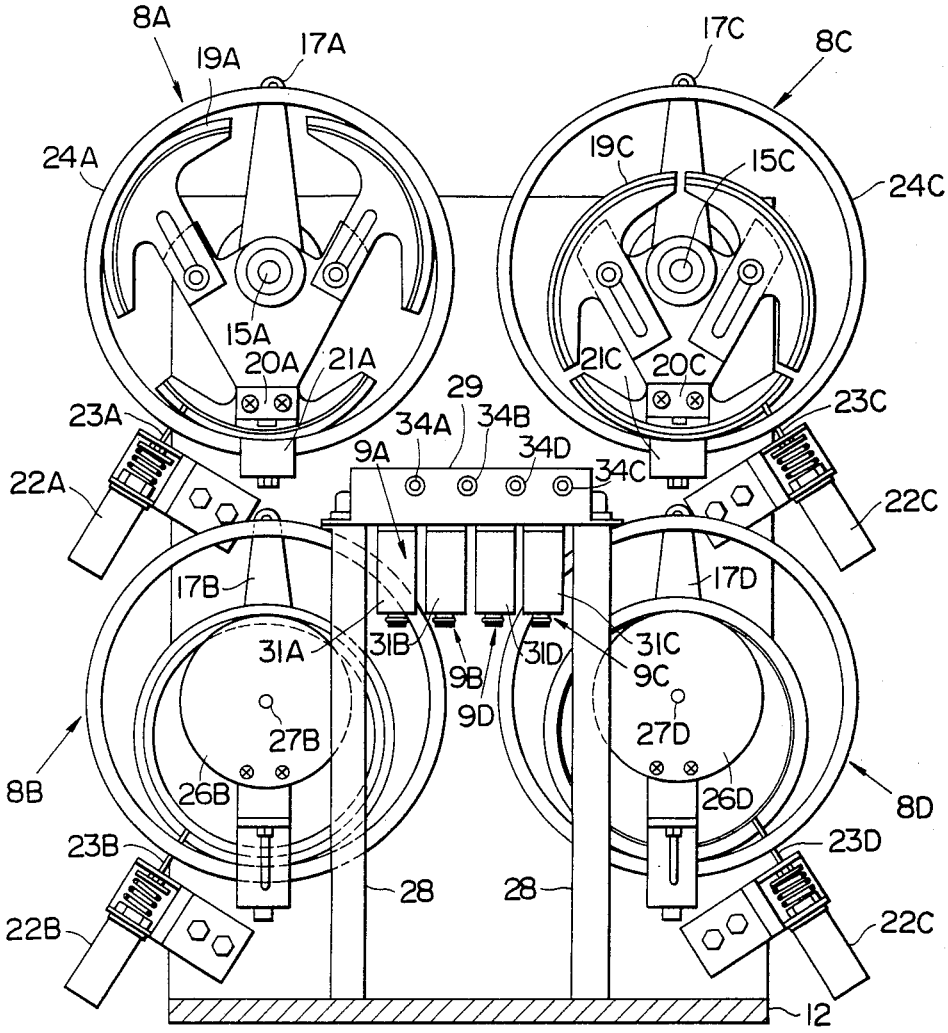
FIG. 4 is a view taken in the direction of an arrow IV of FIG. 2.
Figure 5:
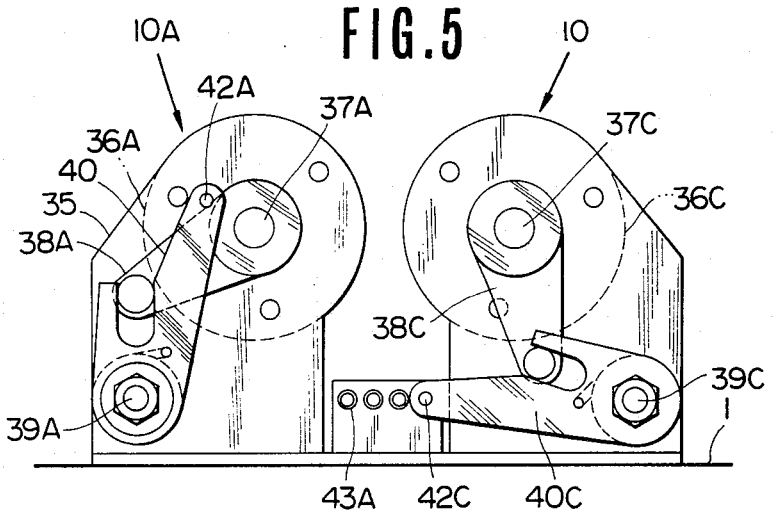
FIG. 5 is a view taken in the direction of an arrow V of FIG. 2.
Figure 6:
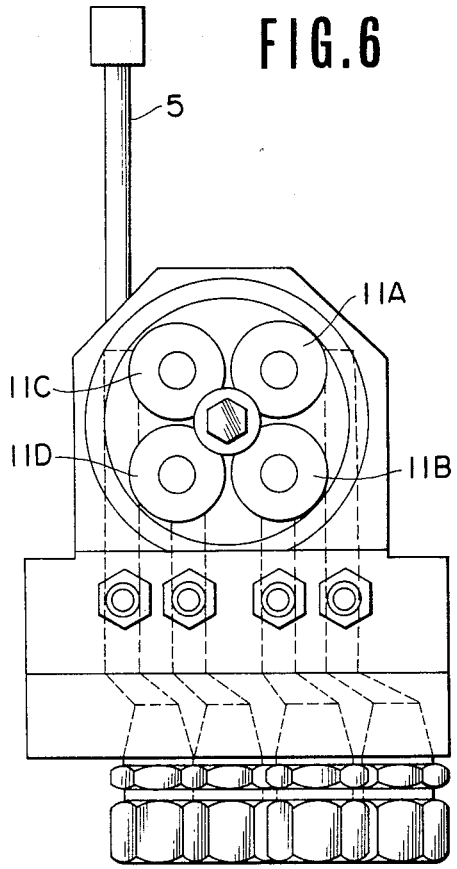
FIG. 6 is a view taken in the direction of an arrow VI of FIG. 2.

Referring now to FIGS. 1 to 6 and more specifically to FIG. 1, there is shown an embodiment of a weft picking system of a multiple colour air jet loom according to the present invention in which the picking of four weft yarns A–D different in color is carried out in accordance with a predetermined pattern. As shown in FIG. 1, a frame 1 of the loom rotatably supports a sley sword shaft 2 on which a reed holder 4 is mounted through sleys 3. The reed holder 4 carries a reed 5, a weft inserting nozzle 6, and a plurality of air guide members 7 through which a weft yarn is guided together with ejected air so as to be picked into the shed of warp yarns (not shown). The loom frame 1 further carries thereon weft measuring devices 8A–8D, weft braking devices 9A–9D, and weft pull-back devices 10A–10D. The reference characters 11A–11D denote weft blow-in nozzles installed on the reed holder in order to supply therethrough weft yarns into the weft inserting nozzle 6. THe blow-in nozzles 11A–11D are provided for the respective four weft yarns A–D different in color.

FIGS. 2 to 6 illustrate the configuration of the weft measuring devices 8A–8D, the weft braking devices 9A–9D, the weft pull-back devices 10A–10D, the weft blow-in nozzles 11A–11D, and the weft inserting nozzle 6. This will be discussed in detail hereinafter in which elements and integers provided for the respective four yarns A–D are indicated by attaching the characters A–D to numerals. The explanation will be made only for the elements and integers corresponding to the weft yarn A for the purpose of simplicity of illustration.

The weft measuring device 8A comprises a pulse motor 13A seurely installed on a support member 12 fixedly attached to the loom frame 1. The pulse motor 13A is arranged to rotate a hollow rotatable shaft 15A which is rotatably supported on the support member 12 through a bearing 14A. The rotatable shaft 15A is formed with a weft drawing-out opening 16A through which the weft yarn A is drawn out from the hollow of the hollow rotatable shaft 15A, the weft yarn A having been supplied from a weft supply device (not shown) and passed through the hollow of the the shaft 15A from the backside of the pulse motor 13A. THe rotatable shaft 15A is fixedly provided with a weft winding-guide arm 17A through which the weft yarn A drawn out from the drawing-out opening 16A is passed. The rotatable shaft 15A has an end section on which a drum 19A is rotatably mounted through a bearing 18A. In this embodiment, the drum 19A is constructed of three separate pieces, and maintained at a stationary state under the action of magnetic attraction created between a magnet 20A fixed to the drum 19A and a magnet 21A fixed on a member (no numeral) separate from the drum 19A. Accordingly, the weft yarn A can be wound around the drum 19A under the rotation of the weft winding-guide arm 17A.

Additionally, an electromagnetic actuator or solenoid 22A is fixedly disposed separate from the drum 19A and provided with an engaging pin 23A connected to the movable iron core thereof. The electromagnetic actuator 22A is so arranged that the engaging pin 23A is projected into a hole (not shown) formed on the surface of the drum 19A when the electromagnetic coil (not shown) is energized, while it 23A is withdrawn from the hole when the electromagnetic coil is de-energized. Additionally, a cover 24A is fixedly provided in the vicinity of the drum 19A for the purpose of restricting weft yarn ballooning phenomena. A ring-shaped weft guide 25A and a baffle plate 26A are fixedly provided for the purpose of guiding the weft yarn A. The baffle plate 26A is provided at its central section with a yarn guide 27A. The weft yarn A from the drum 19A is passed through the baffle plate yarn guide 27A via the ring-shaped weft guide 25A.

The weft braking device 9A comprises a stationary member 30A secured to a support plate 29 which is fixedly supported on the support member 12 through a stud 28. The stationary member 30A is co-operative with a movable member 32A which is connected to a movable iron core (not shown) of an electromagnetic actuator or solenoid 31A fixed on the support plate 29. The support plate 29 carries weft guides 33A, 34A. Accordingly, the weft yarn A from the guide 27A of the weft measuring device baffle plate 26A is passed through the guides 33A and 34A so that a part of the weft yarn A between the guides 33A, 34A is located between the stationary and movable members 30A, 32A. The movable member 32A is arranged to move upwardly to separate from the stationary member 30A thereby to release the weft yarn A when the electromagnetic actuator 31A is energized, while to move downwardly to close to the stationary member 30A thereby to catch or grasp the weft yarn A when the same actuator is de-energized.

The weft pull-back device 10A comprises an electromagnetic actuator or rotary solenoid 36A which is secured to a support plate 35 fastened on the loomn frame 1. A drive lever 38A is fixedly mounted at its one end on a rotatable shaft 37A of the rotatary solenoid 36A, and is engaged at the other end thereof with a pull-back lever 40A which is rotatable about a stationary shaft 39A. The stationary shaft 39A carries thereon a helical spring 41A whose one end is engaged with the end face of a large-diameter section of the stationary shaft 39A and whose other end is engaged with the pull-back lever 40A, so that the pull-back lever 40A is normally biased counterclockwise in FIG. 5. The pull-back lever 40A is formed with a guide opening 42A through which the weft yarn A is passed through. The reference numerals 43A, 44A denote weft guides for guiding the weft yarn A.

Now, as shown, the weft yarn A from the guide 34A of the weft braking device 9A is passed through the guide 43A, the guide opening 42A of the pull-back lever 40A, and the guide 44A in the mentioned order. When the rotary solenoid 36A is energized, the pull-back lever 40A is turned clockwise in FIG. 5 by the drive lever 38A, so that the guide opening 42A of the pull-back lever 40A is brought into alignment with a line connecting the guides 43A and 44A, thereby making the passage of the weft yarn A straight. The reference numeral 45A also denotes a weft guide for guiding the weft yarn A.

The weft inserting nozzle 6 is securely mounted on the reed holder 4 at an end section of the insertion side in such a manner that its tip section is oriented to the guide opening of each air guide member 7. The blow-in nozzle 11A is fixedly mounted behind the weft inserting nozzle 6 together with the other blow-in nozzles 11A–11D in such a manner that the tip section of each blow-in nozzle is oriented to the weft introduction opening formed at the rear end of the weft inserting nozzle 6. As shown, the weft yarn A from the guide 45A of the weft pull-back device 10A is passed through the weft introduction opening of the blow-in nozzle 11A. It will be understood that the weft inserting nozzle 6 and the weft blow-in nozzle 11A are supplied with pressurized air from a pressurized air source (not shown) through electromagnetic valves (not shown), respectively.

Figure 7A:
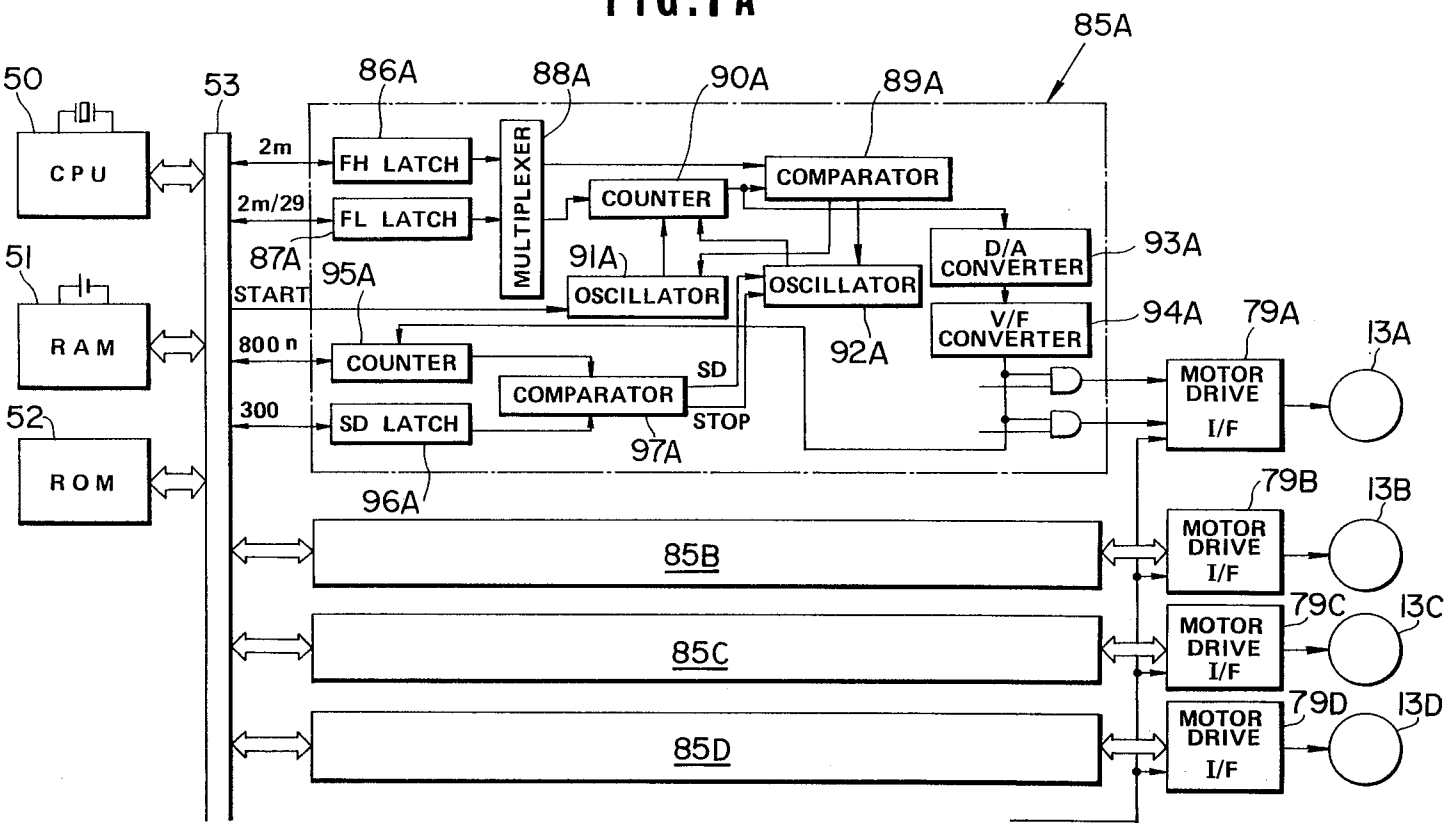
FIG. 7A is a part of a block diagram of an electronic control circuit for controlling the operation of the weft picking system.
Figure 7B:
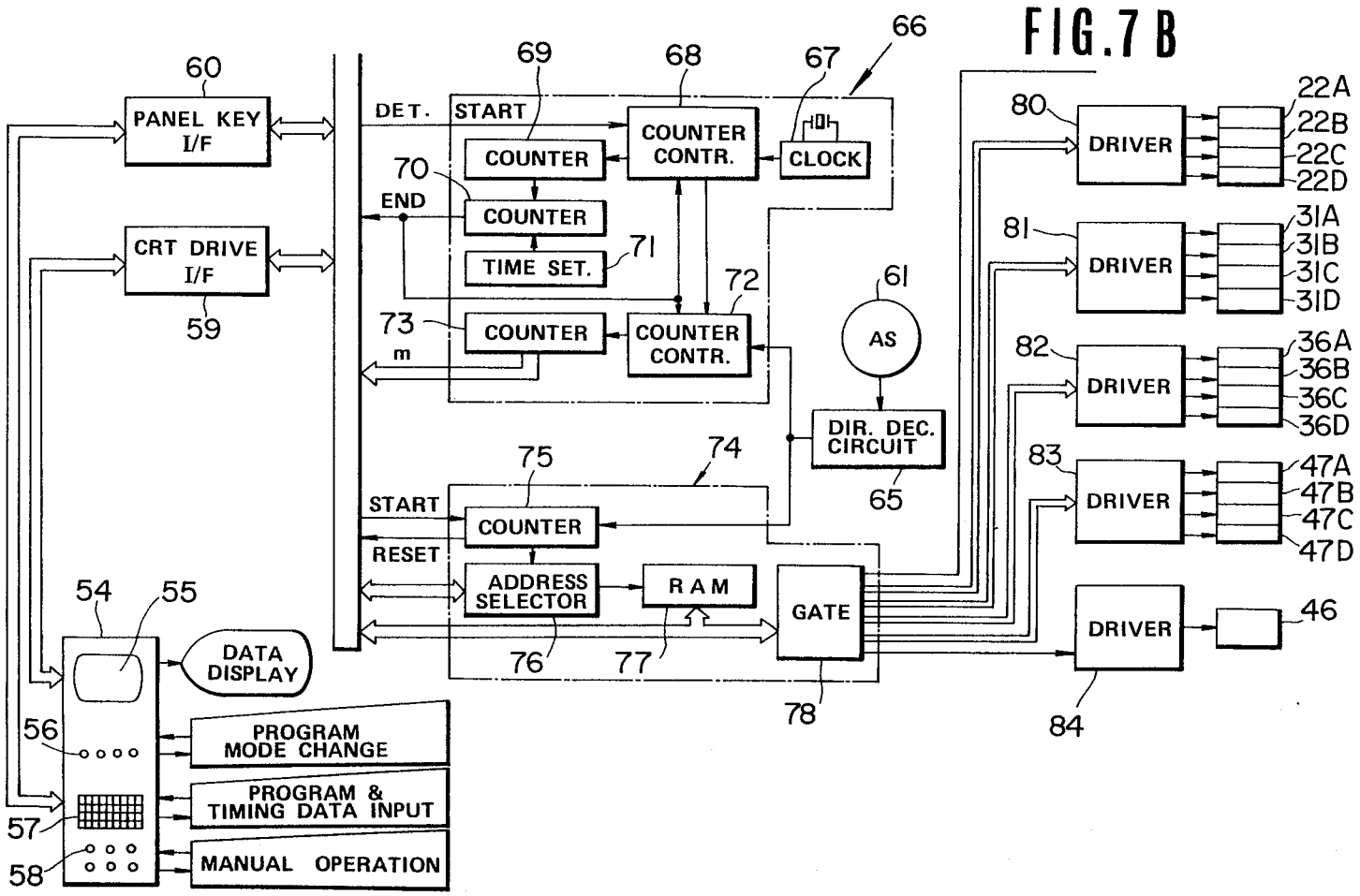
FIG. 7B is the remaining part of the block diagram of the electronic control circuit of FIG. 7A.

FIGS. 7A and 7B show a control system for controlling the operation of the pulse motor 13A, the solenoid 22A for actuating the engaging pin 23A, the solenoid 31A for actuating the weft braking device 9A, the rotary solenoid 36A for actuating the weft pull-back device 10A, a solenoid 46 for the electromagnetic valve through which pressurized air is supplied to the weft inserting nozzle 6, and a solenoid 47A of the electromagnetic valve through which pressurized air is supplied to the weft blow-in nozzle 11A. As illustrated in FIG. 7, the control system comprises a CPU 50, a RAM 51, a ROM 52, and a bus line 53. The reference numeral 54 denotes an operation panel which is provided thereon a CRT display 55, program mode changing buttons 56, a keyboard 57 for program and timing data input, and buttons 58 for manual operation. The operation panel 54 is connected to a CRT drive interface 59, and a panel key interface 60.

An angle sensor 61 is located to face a mark 64 formed on the backside of a hand-operated wheel 63 fixedly mounted on a loom main shaft 62 rotatable in accordance with the loom revolution or cycle, as shown in FIG. 1. The angle sensor 61 functions to generate a reference signal every rotation (360°) of the main shaft 62, and to generate a position signal every rotation (1°) of the shaft 62. The reference numeral 65 denotes a direction decision circuit.

A loom revolution speed detecting circuit 66 comprises a clock 67, a counter controller 68, a counter 69, a comparator 70, a time setting device 71, a counter controller 72, and a counter 73. The loom revolution speed detecting circuit 66 so functions that the counter 69 counts 1 msec. clock signals of the clock 67 since the timing of a detection starting signal of the CPU 50 which starting signal is generated at a predetermined time interval, for example, every 20 times rotations of the loom main shaft 62; and when the value of such a count reaches a setting value (for example, 1111) of the time setting device 71, the comparator 70 generates a detecting terminating signal. A time duration between the timings of the starting and terminating signals is a measuring time Tc (=1.111 seconds) during which output pulses (the number P1 of pulses in one revolution =360) is counted by the counter 73 to detect a count value m. It is to be noted that one revolution (during which one pick of the weft yarn is carried out) of the loom corresponds to one rotation of the loom main shaft 62.

Here, if the time of one revolution of the loom is T (second), a loom revolution speed N (rpm) becomes 60/T. Additionally, since the time T is P1·Tc/m, the loom revolution speed N becomes 60m/(P1·Tc). Accordingly, if P1 is 360 and Tc is 1.111, N and T are represented by the following equations:

$$N=60m/(360\times 1.111)=60m/400$$

$$T=(360\times 1.111)/m=400/m$$

Therefore, m is the data of the loom revolution speed, and this data is memorized by the CPU 50 and renewed every measuring.

If the weft yarn A of the length for one pick is measured upon being wound n times around the drum 19A, and the pulse motor turns $\alpha°$ under the action of one pulse, the number P of pulses to be provided to the pulse motor 13A in order to measure the weft yarn A of the length for one pick is represented by the following equation:

$$P=360n/\alpha$$

Accordingly, when n is 4 and $\alpha$ is 1.8°, P becomes 800. Additionally, the frequency for measuring the weft yarn length for one pick per one rotation of the loom main shaft is as follows:

$$FH=P/T=800/(400/m)=2m$$

This becomes a setting value of a FH latch 86A discussed below.

A timing circuit 74 comprises a counter 75, an address selector 76, a RAM 77, and a gate 78. The timing circuit 74 so functions that, in order to achieve a sequence drive of the pulse motor and the various solenoids in accordance with the program drive command of the CPU 50, each timing angle preset in the keyboard 57 is detected by counting the output pulses of the angle sensor 61 thereby to drive the pulse motor and the various solenoids at respective timing angles. The reference numeral 79A designates a motor drive interface, and 80–84 drivers for driving the various solenoids.

A motor acceleration and deceleration circuit 85 comprises a frequency increase and decrease controlling section including a high speed frequency setting latch (the FH latch) 86A, a low speed frequency setting latch (a FL latch) 87A, a multiplexer 88A, a comparator 89A, a counter 90A, an oscillator 91A for slow-up mode operation, an oscillator 92A for slow-down mode operation 92A, a D/A converter 93A, and a V/F converter 94A. The circuit 85 further comprises a pulse distribution division including a counter 95A, a latch for slow-down mode operation (a SD latch) 96A, and a comparator 97A.

The function of the motor acceleration and deceleration circuit 85 will be explained hereinafter. First, the slow-up mode operation is as follows: a setting value (a high speed frequency at a constant speed) 2 m of the FH latch 86A is preset in the comparator 89A, and a setting value (an initial speed frequency) 2 m/39 is preset in the counter 90A. Then, the oscillator 91A is oscillated under the starting command (274°) of the CPU 50. At this time, the oscillation is made upon counting up the clock pulses of the oscillator 91A from the preset value of the FL latch to the preset value of the FH latch at an acceleration of (FH−FL)/Tu where Tu is a slow-up mode operation time. AFter the FH latch value is reached, the steady oscillation of 2 m is continued until the initiation of the slow-down mode operation discussed below. The pulses of this oscillation is shaped as pulses for driving the pulse motor 13A by means of the D/A converter 93A and the V/F converter 95A.

A program data 800 n is preset in the counter 95A of the pulse distribution section, and a setting value 300 of the SD latch 96A is preset in the comparator 97A. The program data 800 n is the product of the number 800 of pulses for measuring one pick weft length and the number n of picks of the weft yarn A, where the pick number n is the number of continuous pickings of the selected weft yarn A. Then, a counting-down is made from the preset value (800 n) in accordance with the output pulses of the V/F converter 94A by the counter 95A, and a slow-down mode operation command is supplied to the oscillator 92A for the slow-down mode operation thereby oscillating it when an agreement is made between the counted value and the preset value (300) of the comparator 97A. Thus, the slow-down mode operation is achieved similarly to the above-discussed slow-up mode operation, in which when the preset value of the counter 95A becomes 0, a stop command is generated thereby stopping the revolution of the pulse motor 13A.

Figure 8:
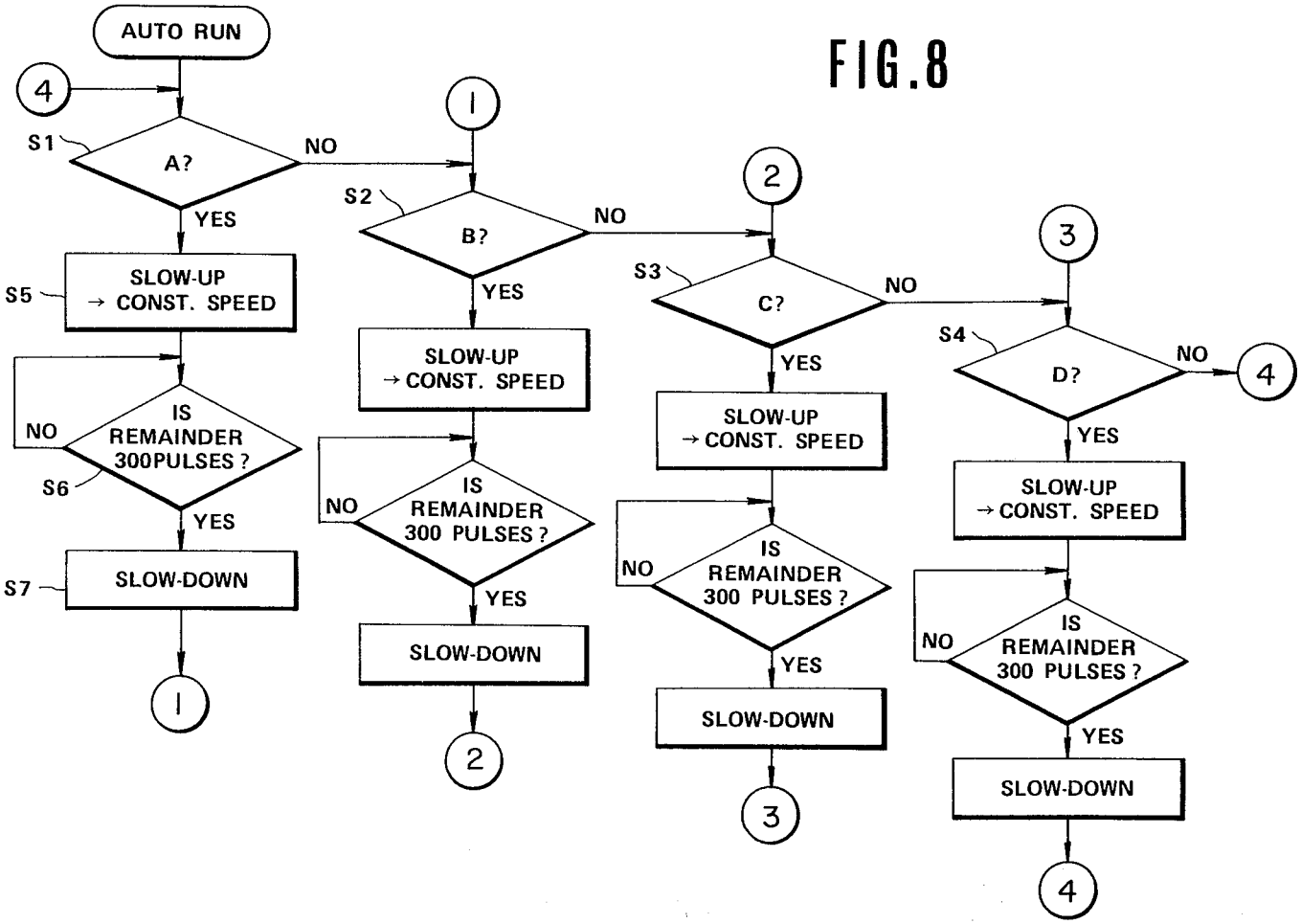
FIG. 8 is a flow chart illustrating the operation of a pulse motor forming part of the weft picking system.

Next, the operation of whole the weft picking system will be discussed with reference to FIGS. 8 and 9 in which an explanation is made only for a case where weft picking is carried out in the order of weft yarns A, B, A, C, C, D, C, B . . . . The input of the pattern of this order is made by the keyboard 57 of the operation panel 54 to be displayed on the display 55.

During the operation of the loom, a decision for the succeeding weft yarn is made at a revolution angle of 274° (S1 to S4). In this case for the weft yarn A, the frequency of the pulses is slowly increased from the FL latch preset value to the FH latch preset value by the motor acceleration and deceleration circuit 85A, providing the pulses to the pulse motor 13A thereby to raise the revolution speed thereof (S5). This corresponds to the slow-up mode operation of the pulse motor 13A. The slow-up mode operation is between the timings of 274° and 220° in the next revolution. It is to be noted that a constant revolution speed of the pulse motor 13A is maintained between the the timings of 175° and 220°. During this slow-up mode operation, 400 pulses (300 pulses between 274° and 175°, and 100 pulses between 175° and 220°) are provided to the pulse motor 13A thereby to cause the weft winding-guide arm to rotate two times. Thus, one half the weft length for one pick is measured. This one half weft length is added to a weft length of the weft yarn which has been already wound around the drum 19A during the slow-down mode operation, thereby to accomplish measuring the weft length for one pick. It is to be noted that a previous winding of the weft yarn on the drum 19A is manually made during the starting of the loom operation.

Prior to the slow-down mode operation, the solenoids 47A, 46 of the electromagnetic valves of the weft blow-in nozzle 11A and the weft inserting nozzle 6 are energized during a time period between the timings of 110° and 220° so that air is ejected from the weft blow-in nozzle 11A and from the weft inserting nozzle 6. Additionally, the rotary solenoid 36A of the weft pull-back device 10A is energized during a time period between the timings of 110° and 10°, and consequently the guide opening 42A of the pull-back lever 40A is brought into a location on the line connecting the front and rear guides 43A, 44A. As a result, the free end section of the weft yarn A is blown into the weft inserting nozzle 6 under the influence of air ejected from the weft blow-in nozzle 11A. Additionally, the solenoid 22A for operating the engaging pin 23A is energized between the timings of 110° and 180°, so that the engaging pin 23A is withdrawn from the hole of the drum 19A, thereby releasing the engagement with the weft yarn A. The solenoid 31A of the weft braking device 9A is energized during a time period between the timings of 110° and 220°, and accordingly the movable member 32A separates from the stationary member 30A thereby releasing the weft yarn A. Thus, the ejected air from the weft inserting nozzle 6 carries the weft yarn A while the ejected air from the weft blow-in nozzle 11A pulls the weft yarn A, thereby accomplishing weft picking. It is to be noted that the engaging pin 23A is projected into the hole of the drum 19A at the timing of 180° which is before the termination (the timing of 220°) of the weft picking in order to separate a weft yarn part to be picked and a weft yarn part to be subsequently measured.

Since the subsequent weft picking is made for the weft yarn B, the pick number n of the weft yarn A in this case is 1, and therefore the preset value of the counter 95A is 800 (pulses). When the count-down is made from 800, 400 is reached at 220° and 300 is reached at 265°. When the value of 300 reached, a slow-down mode operation command is generated (S6 and S7) thereby shifting the operation of the pulse motor 13A to the slow-down mode. In other words, the revolution speed of the pulse motor 13A is decelerated at a predetermined rate between 265° and 166° in the next revolution of the loom, and then the pulse motor 13A is stopped. The pulse motor 13A makes two revolutions under the action of 400 pulses during the time period from 220° to 166°, so that the weft yarn A is wound two times around the drum 19A thereby measuring one half the weft length for one pick. This amount of weft length will be added to the amount of weft length which is measured out during the slow-up mode operation of the subsequent picking of the weft yarn A in order to attain the weft length for one pick. The rotary solenoid 36A of the weft pull-back device 10A is de-energized after the weft yarn A is cut upon completion of beating-up operation or reed 5 (in FIG. 1), so that the pull-back lever 40 is rotated under the action of the helical spring 41A, thereby pulling the weft yarn A back to the blow-in nozzle 11A.

Then, a decision for the subsequent weft yarn is made after a slow-down mode operation command is generated upon the value of the counter 95A becoming 300. In this case, since the subsequent weft yarn is of B, the revolution speed of the pulse motor rises up at a predetermined acceleration from the timing of 274°. Hereinafter, the weft picking of the weft yarns is similarly carried out in the order of B, A, C, C, D, C, B . . . .

Figure 9:
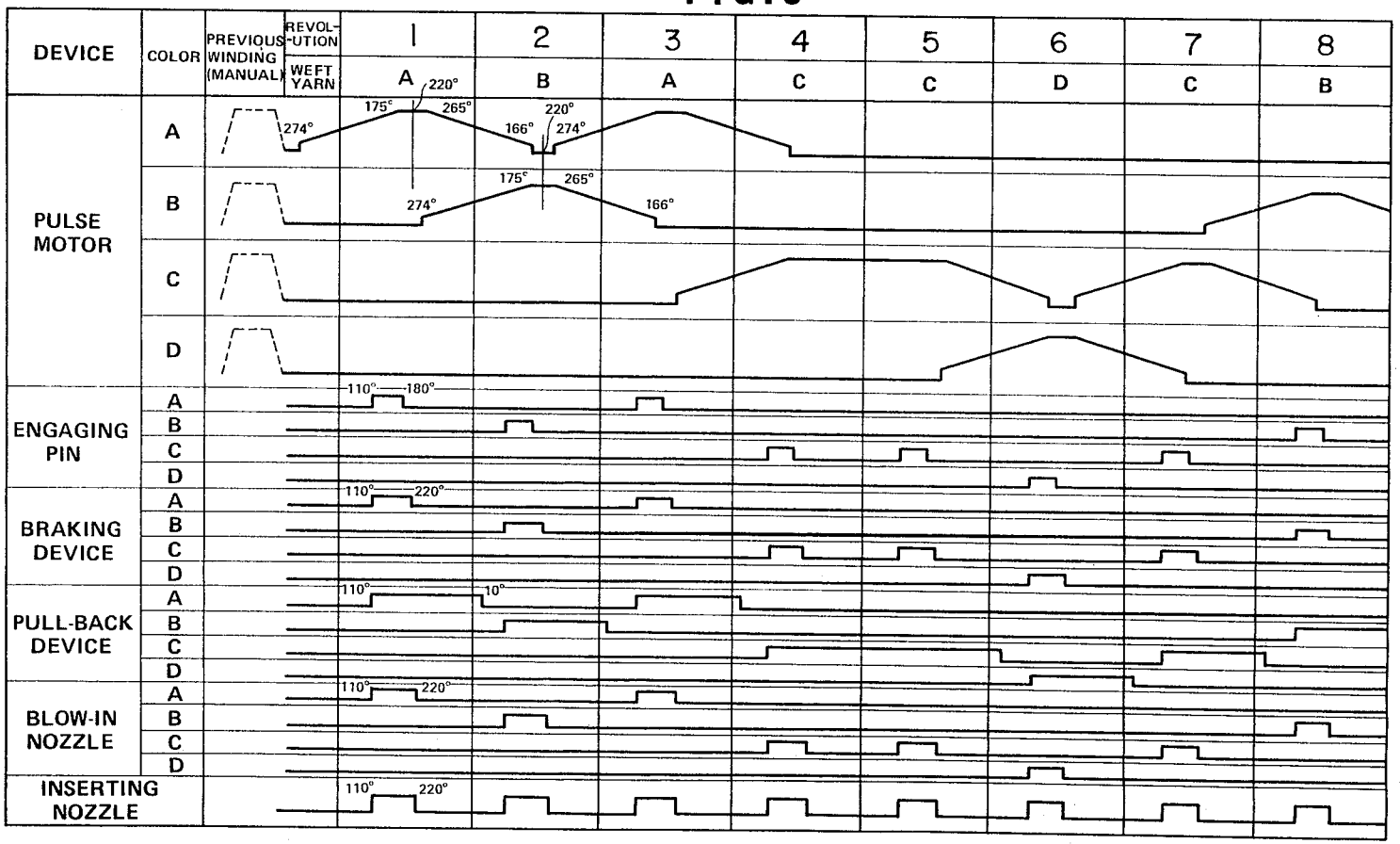
FIG. 9 is a chart showing the operation timings of the weft picking system.

As seen particularly from FIG. 9, the pulse motor 13A is so arranged as to begin its revolutions a predetermined time after the previous revolutions stop so that the revolution and stop durations are apparently separate from each other. This is because, if the revolution speed of the pulse motor 13A is raised immediately after it stops, the pulse motor step-out increases due to the inertia of the driving section of the pulse motor thus causing the pulse motor to not operate. In addition, in order to secure the necessary number of pulses without decreasing the number of pulses within the revolution rise and fall times, the operational characteristics of the pulse motor are designed so that a constant revolution speed is obtained during part of the slow-up and slow-down operations.

As will be appreciated from the above, according to the above-discussed embodiment, the rotation speed of the weft winding-guide arm for weft length measuring can slowly rise up and slowly fall to stop the weft winding-guide arm under the action of the pulse motor, thereby effectively solving the problem of weft yarn being cut off during weft length measuring. Furthermore, the employment of the pulse motor enables the weft-winding guide arm to be mounted on the rotatable shaft of the motor so as to noticeably reduce component parts serving as inertial mass, thereby improving the controllability of the weft picking system. Moreover, the engaging pin and the weft pull-back device can be driven by the respective solenoids, and therefore the operation timing of them is easily adjustable while being freely controllable, thereby making the weft picking system suitable for multiple color looms.

What is claimed is:

1. A method of operating a weft picking system of a loom, of the type wherein a weft yarn is wound around a stationarily maintained drum by a weft winding-guide member rotated a predetermined number of times to measure out a length of the weft yarn to be picked through a weft inserting nozzle, said method comprising:

driving said weft winding-guide member by a pulse motor having a variable revolution speed;

slowly decreasing the revolution speed of said pulse motor from a predetermined level until said pulse motor stops so as to measure out a predetermined portion of a weft length to be required for one pick of the weft yarn by a point in time at which said pulse motor stops; and slowly increasing the revolution speed of said pulse motor to said predetermined level from an initiation of revolution of said pulse motor so as to measure out a remaining portion of said weft length by a point in time at which weft picking terminates.

2. A method as claimed in claim 1, wherein said weft yarn is a predetermined one selected from a plurality of weft yarns.

3. A method as claimed in claim 1, further comprising repeating the step of slowly decreasing and including a step of maintaining the revolution speed of said pulse motor at a constant level between the step of slowly increasing and repeating the step of slowly decreasing.

4. A method as claimed in claim 1, further comprising a step of initiating revolution of said pulse motor a predetermined time after said pulse motor stops.

5. A method as claimed in claim 1, wherein the revolution speed of said pulse motor is slowly decreased at a predetermined rate.

6. A method as claimed in claim 1, wherein the revolution speed of said pulse motor is slowly increased at a predetermined rate.

7. A weft picking system of a loom, comprising:

a weft winding-guide member for winding a weft yarn around a stationarily maintained drum when rotated a predetermined number of times to measure out the length of the weft yarn to be picked;

a weft inserting nozzle from which the weft yarn is picked under the influence of a fluid jet;

a pulse motor for driving said weft winding-guide member;

means for slowly decreasing a revolution speed of said pulse motor, when operated, from a predetermined level until said pulse motor stops, so as to measure out a predetermined portion of a weft length to be required for one pick of the weft yarn by a point in time at which said pulse motor stops; and means for slowly increasing the revolution speed of said pulse motor, when operated to said predetermined level from an initiation of revolution of said pulse motor so as to measure out a remaining portion of said weft length by a point in time at which weft picking terminates.

8. A weft picking system as claimed in claim 7, further comprising means for selecting said weft yarn from a plurality of weft yarns.

9. A weft picking system as claimed in claim 7, further comprising means for maintaining the revolution speed of said pulse motor at a constant level for a time duration between an operation of said slowly increasing means and an operation of said slowly decreasing means.

10. A weft picking system as claimed in claim 7, further comprising means for initiating revolution of said pulse motor a predetermined time after said pulse motor stops.

11. A weft picking system as claimed in claim 7, wherein said pulse motor revolution speed decreasing means includes means for decreasing the revolution speed at a predetermined rate.

12. A weft picking system as claimed in claim 7, wherein said pulse motor revolution speed increasing means includes means for increasing the revolution speed at a predetermined rate.

13. A weft picking system as claimed in claim 7, further comprising:

an engaging pin member having a first state projecting into a hole formed on said drum so as to make an engagement with the weft yarn, when actuated;

a weft pull-back device for pulling back the weft yarn inserted in said weft inserting nozzle;

a first electromagnetic actuator for actuating said engaging pin;

a second electromagnetic actuator for actuating said weft pull-back device; and a control circuit for controlling operations of said pulse motor, and said first and second electromagnetic actuators in timed relation to a rotation of a main shaft of the loom.

14. A weft picking system as claimed in claim 13, wherein said engaging pin is capable of taking a second state to be withdrawn from the hole formed on said drum so as to release the weft yarn.

15. A weft measuring and detaining method for a loom of a type wherein a plurality of weft yarns are selected to be picked in accordance with a program, in which a selected weft yarn is wound around a stationarily maintained drum by a weft winding-guide member rotated a predetermined number of times to measure out a length of the weft yarn to be picked through a weft inserting nozzle, said method comprising:

driving said weft winding-guide member by a pulse motor having a variable revolution speed;

slowly decreasing the revolution speed of said pulse motor at a predetermined deceleration rate from a predetermined level until said pulse motor stops after completion of a final step of a first weft selection program for the selected weft yarn, so as to measure out a predetermined portion of a weft length to be required for one pick of the weft yarn by a point in time at which said pulse motor stops; and slowly increasing the revolution speed of said pulse motor at a predetermined acceleration rate to a predetermined level from initiation of revolution of said pulse motor in a second weft selection program which is after said first weft selection program, so as to measure a remaining portion of said weft length by a point in time at which weft picking terminates.

16. A weft measuring and detaining method as claimed in claim 15, wherein said predetermined level revolution speed is a speed level at which said weft length required for one pick is measured during one rotation of a main shaft of the loom.

17. A weft measuring and detaining method as claimed in claim 15, wherein said predetermined deceleration rate and acceleration rate continue for first and second time periods, respectively, each corresponding to a major part of a predetermined time required for one rotation of a main shaft of the loom, in which said first time period is continuous after a third time period and before a fourth time period in said revolution speed slowly decreasing step, the revolution speed of said pulse motor being at said predetermined level for said third time period and at zero for said fourth time period, said second time period being continuous after said fourth time period and before said third time period.

18. A weft measuring and detaining method as claimed in claim 17, wherein a second weft yarn is in the revolution speed slowly increasing step when a first weft yarn is in the revolution speed slowly decreasing step, said first weft yarn being earlier in weft picking than said second weft yarn, the total of the first weft yarn upon completion of the revolution speed slowly decreasing step and the second weft yarn upon completion of the revolution speed slowly increasing step corresponding to the weft yarn length required for one pick.

19. A weft measuring and detaining method as claimed in claim 15, wherein said first and second weft selection programs are related to a colour pattern of a fabric to be woven.

20. A weft measuring and detaining method as claimed in claim 15, wherein said predetermined portion and said remaining portion of said weft length are each about ½ of the weft length required for one pick.

21. A weft picking system of a loom of a type wherein a plurality of weft yarns are selectively picked, said weft picking systfem comprising:

a plurality of stationarily maintained drums;

a weft winding-guide member provided for each drum and for winding a weft yarn around said drum when rotated a predetermined number of times to measure a length of the weft yarn to be picked;

a pulse motor for rotating said weft winding-guide member when revolving, said pulse motor having a variable revolution speed and being so arranged that the revolution speed is slowly decreased from a predetermined level until said pulse motor stops, when operated in a first manner, so as to measure a predetermined portion of a weft length required for one pick by a point in time at which said pulse motor stops, and that the revolution speed of said pulse motor is slowly increased into said predetermined level from initiation of revolution of said pulse motor when operated in a second manner, so as to measure a remaining portion of said weft length by a point in time at which weft picking terminates;

a weft inserting nozzle from which the weft yarn is picked under influence of a fluid jet to be ejected from said nozzle, said nozzle including an electromagnetically operated valve for controlling the fluid jet;

an electromagnetically operated engaging pin member having a first state projecting into a hole formed on said drum so as to make an engagement with the weft yarn;

an electromagnetically operated weft pull-back device for pulling back the weft yarn inserted in said weft inserting nozzle.

means for selecting said weft yarn to be picked from a plurality of weft yarns in accordance with a program; and a control circuit including program inputting means for inputting said program, and control means for controlling operation of said pulse motor, said valve of said weft inserting nozzle, said engaging pin, said weft pull-back device in accordance with said program and in timed relation to revolution speed of the loom.

22. A weft picking system as claimed in claim 21, wherein said program is in connection with colour pattern of a fabric to be woven.

* * * * *